United States Patent [19]

Betz

[11] 3,987,266

[45] Oct. 19, 1976

[54] CONTAMINATION PROTECTED ELECTRICAL SWITCH, PARTICULARLY AUTOMOTIVE IGNITION BREAKER CONTACT STRUCTURE

[75] Inventor: Dieter Betz, Stuttgart, Germany

[73] Assignee: Robert Bosch G.m.b.H., Gerlingen-Schillerhohe, Germany

[22] Filed: Aug. 6, 1974

[21] Appl. No.: 495,111

[30] Foreign Application Priority Data

Sept. 6, 1973 Germany ..... 2344856
Oct. 15, 1973 Germany ..... 2351663

[52] U.S. Cl. ..... 200/302; 200/30 A
[51] Int. Cl.[2] ..... H01H 9/04
[58] Field of Search ..... 200/302, 30; 74/18.2; 277/212

[56] References Cited

UNITED STATES PATENTS

| | | | |
|---|---|---|---|
| 2,677,741 | 5/1954 | Martin | 200/302 |
| 2,824,183 | 2/1958 | Marasco et al. | 200/302 X |
| 3,363,078 | 1/1968 | Ishizaki | 200/302 X |
| 3,711,668 | 1/1973 | Harnden, Jr. | 200/302 X |

*Primary Examiner*—Herman J. Hohauser
*Attorney, Agent, or Firm*—Flynn & Frishauf

[57] ABSTRACT

To improve the operating reliability and accuracy of ignition breaker contacts, an operating rod passes into a sealed housing, in gas-tight manner, by being secured, gas-tight, to a membrane which is resiliently deflectable, the breaker rod reciprocating under control of an engine operating cam, the membrane effecting a gas-tight seal while, by resilient deflection, transferring operating movement into the interior of the breaker switch housing; the breaker contacts are retained in the housing. A spring is used to provide for operating force, or the membrane may be pre-stressed; the interior of the housing may be evacuated or may contain a protective, inert gas.

25 Claims, 8 Drawing Figures

CONTAMINATION PROTECTED ELECTRICAL SWITCH, PARTICULARLY AUTOMOTIVE IGNITION BREAKER CONTACT STRUCTURE

The present invention relates to a contamination protected electrical switch structure, and more particularly to such a structure which is capable of repeated, rapidly following operation, used for example as the breaker switch contact in the ignition system of internal combustion engines.

It has previously been proposed to carry an operating bolt or operating rod into the interior of a breaker switch housing by forming a bore through a threaded stub, or adjustment screw, and provide an oil seal where the bolt passes through the bore to prevent the entry of oil, water, dust, dirt, or other contamination into the interior of the breaker switch. It has been found that sealing the movable bolt leads to difficulties; the interior space of the switch housing frequently is under an air pressure which differs from ambient; the air pressure may be either higher or lower. It would be desirable to construct the switch in such a manner that it operates either under a vacuum, or in an inert atmosphere at over-pressure, both vacuum or over-pressure being reliably maintained within the interior of the switch.

It has also been proposed to construct a switch by securing a movable contact, or a cam operating the movable contact on a membrane which seals one wall of the switch housing, so that the switch housing can be filled with a protective, inert gas. Such switches have the disadvantage that the tension on the membrane changes with the inner pressure within the switch and thus leads to difficulties with respect to operating accuracy, that is, the exact timing of switch operation, as well as resulting in difficulties with respect to overall adjustment. These difficulties particularly arise if the switch is subjected to substantial changes in temperature which frequently arise when such switches are used as ignition breaker switches in automotive vehicles.

It is an object of the present invention to provide a mechanically operated switch, which is particularly suitable as a breaker switch for the ignition system of automotive vehicles, which is capable of carrying a high current, can operate at high voltages, can operate with high switching repetition rates up to several hundreds of Hertz, and which additionally is reliable in operation and essentially free from maintenance.

SUBJECT MATTER OF THE PRESENT INVENTION

Briefly, the mechanical operating switch has a membrane located in a wall of the housing, the membrane being penetrated by a reciprocating operating rod which, in turn, operates the movable contact of the switch. The membrane is sealed, on the one hand, to the switch housing and, on the other, to the operating rod, in a gas-tight manner. A spring provides a bias force to the movable contact. Electrical contact operation of such a switch is essentially independent of the inner pressure in the switch, so that the accuracy of switch operation is high, and the adjustment of the switching instant is easily accomplished. A particularly reliable embodiment of the invention utilizes a single, unitary operating rod which is tightly surrounded by the membrane.

In a preferred form of the invention, the membrane has a surface which is greater than the area which it closes off, for example by being corrugated or undulated; such a membrane can readily stretch, and yet is inexpensive and easily manufactured, and thus suitable for use in such a switch. Other forms of membranes may also be used, particularly generally U-shaped or V-shaped membranes, which have an even higher elasticity than a membrane extending essentially in one plane, and thus exert only minimum damping force on the switch operating rod.

The membrane may be pre-stressed in order to assist the operating force of the switch, or completely take over the operating forces to open, or close the switch, respectively. Such a construction can be used with good advantage when the switch is constructed as a protective, inert gas switch in which the interior of the switch housing is filled with an inert gas under some overpressure, the overpressure of the inert gas acting on the membrane, the force of which can be used in simple manner to close a normally closed (N/C) contact. The overpressure may be used alone, or in cooperation with the additional spring force to close the contact.

The switch, in accordance with a feature of the present invention, preferably is formed as a cap-shaped housing, for example circular in cross section, and closed off at the open end by the membrane; the operating rod then, preferably, is centrally located, and the inner end thereof bears against a compression spring which is located to fit against the inner wall of the central portion of the cap forming the switch housing. The spring forms one of the operating forces for the switch, being alternately compressed by an outside force exerted against the operating rod, for example by a cam, to open, or close the contacts within the housing. The switch can be constructed as an N/C or as a normally open (N/O) contact switch, or as a changeover switch with two contacts, being alternately engaged by a movable switch element. The spring, within the housing, may supply the entire operating force for the switch, in one direction, or may be used in combination with pneumatic forces, as previously referred to, for example inert gas under pressure. The interior of the switch housing may also be evacuated, the vacuum being used to support the spring force, or to support the operating force counteracting the spring, in order to operate the switch contacts.

If the switch is constructed to operate in an inert, protected gas atmosphere, then it is desirable that at least one of the switch contacts has been dipped in mercury. Sinter metal contacts with mercury contained therein are preferably used. Such contacts are practically free of wear, and require practically no maintenance or cleaning.

For ease of assembly and manufacture, it may be desirable to construct the operating rod of more than one part, the parts being rigidly connected with each other. Sealing between membrane and operating rod is facilitated by such multiple-part construction; a particularly simple connection arrangement utilizes an operating bolt made of two parts, one having a threaded stub extension which can thread into a threaded bore of the other, the threaded stub extension penetrating the membrane through an opening just fitting over the outer diameter of the threads. By tightly screwing the two parts together, with the membrane sandwiched therebetween, an excellent seal is provided. An inserted sealing disk further improves the gas-tightness, with only minimum additional material and labor requirements. For mass production in large quantities, in which the apparatus for automatic production may be of sophisticated construction, a two-part operating rod with flat end faces, which are soldered, brazed, or welded to the membrane, with the membrane sandwiched therebetween, is particularly suitable.

The invention will be described by way of example with reference to the accompanying drawings, wherein.

Figure 1:
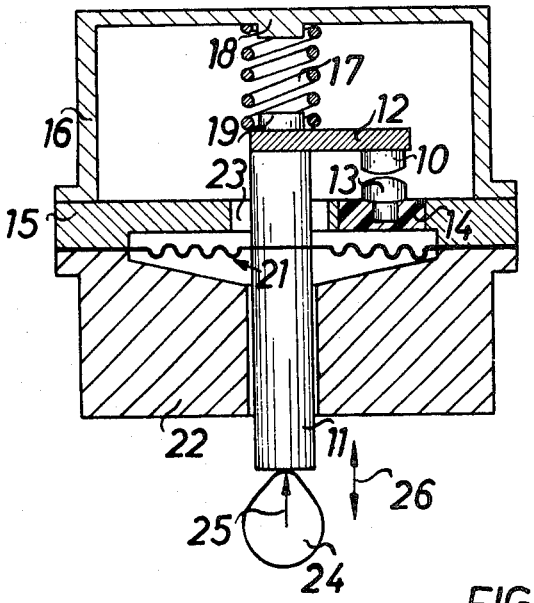
FIG. 1 is an axial longitudinal cross-sectional view through a switch which, in plan view, is circular.

For purposes of illustration, the switch of FIG. 1 is a vacuum switch, to be used as an ignition breaker contact switch for internal combustion engines. The movable contact 10 is eccentrically located in the switch, secured by an arm 12 to an operating rod 11. The carrying arm 12 is metal, connecting the movable contact to chassis or ground. The movable contact is opposed to fixed contact 13 which is secured in an insulating block 14, and connected to the outside of the housing by a suitably insulated conductor, or pigtail, not shown, and sealed into the housing. The insulating element 14 is secured to a base plate 15 of the housing which, further, includes a cap 16, generally pot-shaped, and formed with an inner projecting stub 18 to center a helical compression spring 17. Spring 17 is biassed, bearing with one end against the inner surface of the cap 16 of the housing, and with its other against the inner end of rod 11. Rod 11 is formed with an extension 19 of reduced diameter to center the spring 17, matching the projection 18 in the housing. The spring 17 tends to move the rod 11 downwardly in FIG. 1, hence tends to close contacts 10, 13.

The switch housing is rigid and stiff, and is closed off by a membrane 21, to provide a gas-tight seal. Membrane 21, like rod 11, is made of metal and is sealed in gas-tight manner both to the rod 11 and to the housing of the switch. The rod 11 is longitudinally guided for reciprocating motion in a socket 22 of the switch housing. It passes through the base plate 15 of the housing in the region of an opening 23, larger than the rod 11. Movement of the rod 11 is controlled by a cam shaft 24. The force acting on the rod 11 is indicated by arrow 25, the movement of the rod 11 is indicated by the double arrow 26.

Figure 2:
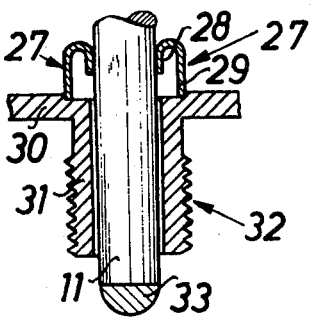
FIGS. 2–5 are fragmentary views through the base plate of switches constructed in accordance with FIG. 1 and illustrating various embodiments of membranes, and guidance of the operating rod.

Membrane 21, FIG. 1, is a corrugated membrane extending generally in a single plane. Membrane 27, FIG. 2, is generally U-shaped, having a shorter leg 28 and a longer leg 29. The shorter leg 28 of membrane 27 is secured in gas-tight manner to the rod 11; the longer leg 29 is secured in gas-tight manner to base plate 30 of the switch housing. The base plate 30 is formed with a hollow stub 31, through which the operating rod 11 is guided. The stub 31 is formed with an outer thread 32 which can be used to screw the switch into a suitable tapped bore. The outer, lower end of the rod 11 is formed with a rounded cap 33 to form a cam follower for engagement with the cam shaft 24, or other operating elements for the switch.

Figure 3:
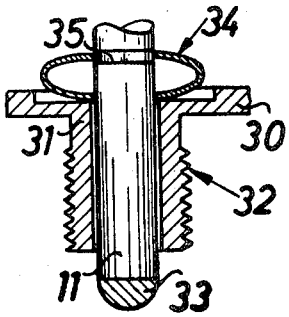
Figure 4:
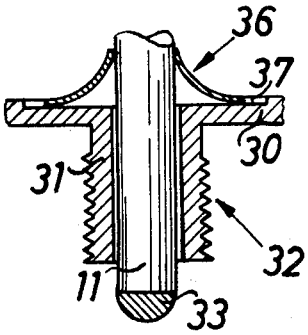
Figure 5:
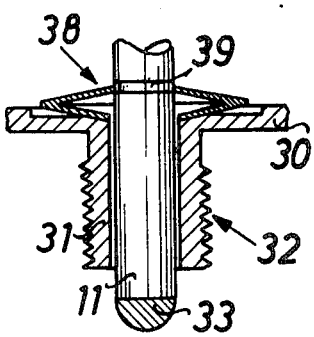

The embodiments of FIGS. 3–5 are similar to the embodiment of FIG. 2, except that the membrane, and its attachment to the housing are different. FIG. 3 shows a generally U-shaped membrane 34, located horizontally, and secured with one of its legs to the operating rod 11′, and with its other leg to the base plate 30. The operating rod 11′ is formed with a circular groove 35 in the region of attachment of the membrane 34, the membrane 34 being fitted into the groove, directly, or by means of additional sealing elements.

FIG. 4 illustrates a membrane 36 which is also generally U-shaped with only a slight bend, however, fitted with its inner rim tightly to the operating rod 11 and fitting with its outer rim into a groove 37 in base plate 30′.

FIG. 5 illustrates a membrane 38 of generally V-shape, having one leg engaging a ring groove of operating rod 11′ and the other leg fitted to the base plate 30″. The membrane 38 engages in the ring groove 39. The base plate 30″ is preferably formed with an inclined groove 130, inclining towards the central bore of the stub 32, to provide for attachment of the membrane to the base plate 30″ close to the region where rod 11′ passes through the membrane.

Figure 6:
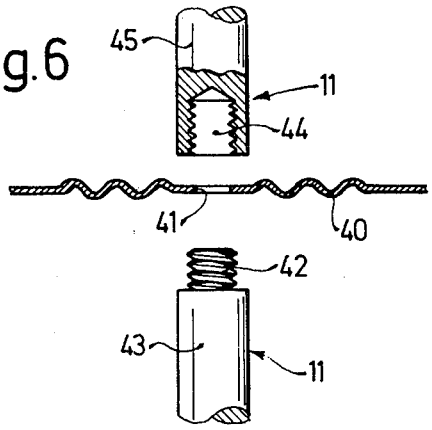
FIG. 6 is a fragmentary exploded cross-sectional view, partly in section, illustrating a connection of the membrane to a threaded two-part operating rod.
Figure 7:
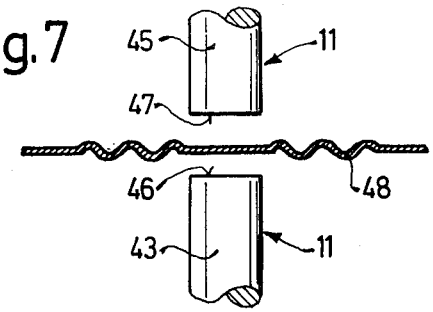
FIGS. 7 and 8 are fragmentary exploded views illustrating connection of a two-part operating rod with flat end faces on the parts to a membrane.
Figure 8:
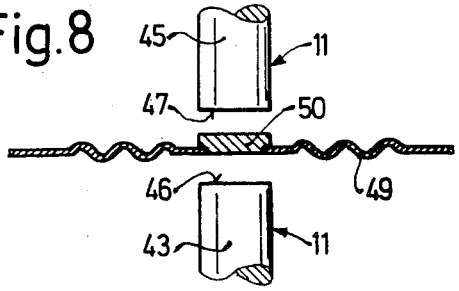

The operating rod may be a two-part element; referring to FIGS. 6–8, and first to FIG. 6: Membrane 40 which, like the membrane 21 of FIG. 1, is generally flat and corrugated, is formed with a central opening 41 through which a threaded stub 42 of operating rod part 43 passes. The threaded stub 42 is screwed into the tapped bore 44 of the second part 45 of the operating rod **11*a*. The membrane is tightly sealed between the two parts 43, 45, when screwed together, to provide a gas-tight seal; if desired, a sealing washer of compressible gas-tight material may be interposed between one, or both of the end faces of the parts 43, 44 and bearing against the membrane 40.**

In the embodiment of FIG. 7, the lower part 43′ and the upper part 45′ of the operating rod **11*b* have flat end faces 46, 47 which fit, flat, against a solid, non-apertured membrane 48. The parts 43′, 45′ are welded together through and to the membrane 48.**

The embodiment of FIG. 8 is similar to that of FIG. 7; parts 43″ and 45″ of the operating rod **11*c* are secured together by soldering. The membrane 49 is apertured, the aperture of the membrane having an insert 50** placed therein which consists of a material which can be easily soldered.

Simple and reliable sealing is obtained by sub-dividing the operating rod in the region of the membrane which, after attachment and re-assembly together, again becomes a fixed unitary operating element. The operating rod **11, 11′, 11*a*, 11*b*, 11*c*** may additionally be sub-divided and formed in various parts for ease of manufacture, or assembly into an ignition breaker assembly, for attachment of cam followers, and the like.

The attachment of the various membranes to the operating bolds, and to the base plate must be matched and fitted to the various types of membranes and sealing arrangements. In many instances, it is sufficient to seal the membrane by drawing the membrane over an edge, preferably with the insertion of a soft sealing ring, for example made out of copper; in those instances in which the seal must meet high requirements, the membrane may be attached by means of soldering, welding, or brazing, the attachment being to the operating rod, or to the base plate, respectively.

The requirements of operating reliability and life free from maintenance which are placed on ignition breaker contacts are constantly increasing. Further, the switching frequency also increases, and the electrical loading also increases. The switch construction, as described, provides for a contacting arrangement which is practically free from maintenance and wear.

The switch illustrated in FIG. 1 is a vacuum switch; the interior of the housing is evacuated; the extent of vacuum is not critical, and the pressure (or, rather, the vacuum) may be in the order of between 100 and $10^{-4}$ Torr. A preferred range is about 1 to 0.1 Torr. Ion formation decreases with increasing vacuum, thus effectively suppressing arcing of the switch. If the vacuum is too low, however, that is, at pressures below about 0.0001 Torr, it has been found that the life expectancy of the contacts decreases. The reason why this decrease should occur is not completely known; indications are that the decrease in life of the contact, at very low pressures, may be due to increased migration of the contact material.

Contacts operating in vacuum operate with practically no wear; it is not possible that an insulating coating or cover layer may form on the contacts. The construction, as proposed, permits operation of the contacts at operating voltages of several hundred volts, and at a current loading of several amperes, with switching frequencies of several hundred Hertz, and at very high accuracy of timing of the switching instant. It is believed that these results are obtained by the use of a membrane which, essentially, only has a sealing function and does not have any damping effect on the switching operation itself. The movable contact is rigidly secured with the operating rod. Due to the sealed closed arrangement, the switch is particularly useful for operation in contaminating atmospheres, for example in corrosive atmospheres, and particularly in such environments in which reliable operation is demanded, switching very small electrical signals only infrequently and after long periods of interruption.

The movable contact 10 and the fixed contact 13 in the embodiment of FIG. 1 are shown as N/C contacts, when the switch is in quiescent condition. Contacting pressure is provided by spring 17 which, as illustrated, is a helical spring. Other springs may be used. If the switch is to be constructed as an inert gas-protected switch, in which the inert gas is introduced into the switch housing under over-pressure, the pressure applied on the membrane by the pressurized gas can be used to assist the contact force. If the over-pressure is sufficiently high, spring 17 may be omitted entirely, particularly if the membrane is so constructed that it is pre-stressed. The contact operation, as before, is controlled over rod 11, and the movable contact which is secured thereto, preferably rigidly secured. A change in interior pressure in the switch does not substantially affect the switching accuracy and timing if the contact force is not provided entirely by the pressure within the switch, as transferred by the membrane. Constructing the switch without an additional operating spring simplifies the mechanical construction, but restricts the utility of the switch to those applications in which accuracy of switching instant is not of paramount importance. If a spring is used in the interior of the switch, changes in interior pressure within the switch have practically no effect on the accuracy of timing of switching, provided the spring force is suitably selected and essentially provides the major portion of the operating force for the switching operation itself.

Various changes and modifications may be made, and features described in connection with any one embodiment may be used with any other embodiment, within the inventive concept.

I claim:

1. Contamination protected electrical switch having a closed, cup-shaped housing (15, 16, 22, 30) having a cap portion (16) and an apertured base plate portion (15);

a fixed contact (13) located in the housing;

a movable contact (10) located in the housing;

an operating rod (11) passing through the apertured base plate portion of the housing and thereinto, the movable contact (10) being operated by the operating rod, the operating rod being reciprocable from outside of the housing to effect engagement and disengagement of the movable contact from the fixed contact, a membrane (21, 27, 34, 36, 38) gas-tightly sealed to the cap portion of the housing to define a sealed chamber in the cap portion of the housing, the membrane being further gas-tightly sealed to the operating rod (11) to provide for gas-tight passage of the operating rod into the housing without leakage and permit reciprocating movement of the operating rod by deflection of the membrane;

and a spring (17) located within the cap portion and exerting a bias force on the movable contact (10) and cooperating with the force due to pressures within the sealed chamber and operating forces applied to the operating rod (11) to provide, by interaction of said operating forces, for opening and closing of the contacts.

2. Switch according to claim 1, wherein the membrane is secured to the housing at the circumference thereof and the operating rod is secured to the membrane essentially centrally thereof.

3. Switch according to claim 1, wherein the movable contact (10) is rigidly secured to the operating rod (11).

4. Switch according to claim 1, wherein a portion (14) of the housing (15, 16) comprises insulating material, the fixed contact being located on said insulated material portion.

5. Switch according to claim 1, wherein the membrane (21, 27, 34, 36, 38) is a metal membrane.

6. Switch according to claim 1, wherein the membrane (21) is a corrugated membrane disk.

7. Switch according to claim 1, wherein (FIGS. 2–4) the membrane (27, 34, 36) is U-shaped.

8. Switch according to claim 1, wherein (FIG. 5) the membrane (38), in cross section, is V-shaped.

9. Switch according to claim 1, wherein the spring (17) is located between the inner end of the operating rod (11) and the inner surface of the cap portion.

10. Switch according to claim 1, wherein the membrane (21, 27, 34, 36, 38) is pre-stressed to provide, at least in part, for operating force to open and close the contacts.

11. Switch according to claim 1, wherein at least one of said contacts (10, 13) is dipped in mercury.

12. Switch according to claim 1, comprising (FIGS. 2–5) an outwardly threaded, hollow stub (31) attached to the base plate, the operating rod (11) passing through the aperture and the stub.

13. Switch according to claim 1, comprising a socket (22) secured to the base plate portion (15) of the housing and formed with an aperture, the operating rod (11) passing through the aperture in the socket and being guided thereby.

14. Switch according to claim 1, wherein the housing retaining the contacts is evacuated.

15. Switch according to claim 14, wherein the vacuum is in the order of from 0.0001 to 100 Torr.

16. Switch according to claim 14, wherein the vacuum is in the order of 0.1 to 1 Torr.

17. Switch according to claim 1, further comprising an inert gas filling the housing to form a protective gas therein.

18. Switch according to claim 17, wherein the protective gas is under a pressure greater than ambient atmospheric pressure.

19. Switch according to claim 1, wherein the operating rod (11) is a unitary element, the membrane being secured to a surface thereof.

20. Switch according to claim 1, wherein (FIGS. 6–8) the operating rod (11) is a multiple-part element (43, 45), the parts being secured together.

21. Switch according to claim 20, wherein (FIG. 6) the operating rod comprises two parts (43, 45), one part (43) being formed with a threaded extension (42) and the other (45) being formed with a tapped bore (44), the threaded extension passing through the membrane (40) and being threaded into the bore.

22. Switch according to claim 20, wherein (FIG. 7) the operating rod comprises two parts (43′, 45′) having facing, flat end faces (46, 47) secured together with the membrane (49) sandwiched therebetween.

23. Switch according to claim 22, wherein the membrane (49) includes an insert element (50) of easily solderable material located in the region between the facing flat end faces (46, 47) of the operating rod (11*c*) to permit ease of uniting the operating rod into a rigid element, sealed to the membrane.

24. Ignition breaker contact construction for incorporation in circuit with the ignition system of internal combustion engines comprising the switch structure of claim 1.

25. Ignition breaker contact construction according to claim 24, wherein the membrane (21, 27, 34, 36, 38) is a metal membrane.

* * * * *